United States Patent [19]

Oda

[11] 4,213,270

[45] Jul. 22, 1980

[54] RADIO CONTROLLED WHEEL TOY

[76] Inventor: Nobuo Oda, 2-26-12 Noge, Setagayaku,Tokyo, Japan

[21] Appl. No.: 931,936

[22] Filed: Aug. 7, 1978

[51] Int. Cl.[2] ..... A63H 30/04

[52] U.S. Cl. ..... 46/254; 46/262

[58] Field of Search ..... 46/254, 255, 210, 252, 46/253, 256, 262, 213; 273/86 B; 343/225

[56] References Cited

U.S. PATENT DOCUMENTS

| | | | |
|---|---|---|---|
| 3,372,393 | 3/1968 | Cataldo | 343/225 |
| 3,590,526 | 7/1971 | Deyerl et al. | 46/262 |
| 3,832,691 | 8/1974 | Galler | 343/225 X |
| 4,080,602 | 3/1978 | Hattori et al. | 46/262 X |
| 4,152,867 | 8/1979 | Ogawa | 46/259 |

FOREIGN PATENT DOCUMENTS

| | | | |
|---|---|---|---|
| 2816416 | 10/1978 | Fed. Rep. of Germany | 46/262 |

*Primary Examiner*—Charles E. Phillips
*Attorney, Agent, or Firm*—Jackson, Jones & Price

[57] ABSTRACT

The direction of movement of a battery-powered wheel toy such as a toy car is controlled by a remotely located, hand-held transmitter. The car has a receiver and two motors mounted thereon, one motor being connected to drive at least one wheel of a first pair of wheels located at a first axle position, and the other motor being connected to drive at least one wheel of a second pair of wheels located at a second axle position. One of the wheel pairs and driving motor are mounted for pivotal rotation about an axis normal to the plane of the support platform for the car. The transmitter sends a modulated carrier signal to the receiver. The carrier is modulated by tone bursts. The duration of the tone bursts is determined by a variable potentiometer that is controlled by the operator at the transmitter. At the receiver, the tone-modulated carrier is detected and demodulated. The duration of the demodulated tone bursts determines the time duration that current is supplied to one DC motor. The duration of the absence of a tone determines the time duration that current is supplied to the other DC motor. By thus controlling the current to the motors, their speed of rotation is controlled which causes the toy car to turn left or right, depending on which motor is rotating faster. The difference in speed of rotation of the two motors determines the turning circle radius of the toy car.

9 Claims, 14 Drawing Figures

RADIO CONTROLLED WHEEL TOY

BACKGROUND OF THE INVENTION

1. Field of the Invention

The present invention relates to wheeled toys, and more particularly, pertains to battery-operated wheeled toys which has its movement controlled by a remotely located wireless device.

2. Description of the Prior Art

In the field of remotely controlled battery operated wheel toys, it has been the practice to employ two small motors, one connected to drive the front right wheel of the wheel toy, and the other connected to drive the front left wheel of the wheel toy, the speed of rotation of the motors being controlled by a two channel transmitter, one channel for each motor.

FIG. 1 illustrates a wheel toy 15 which most commonly may take the shape of an automobile having an antenna 23 for reception of the radio control waves, a transmitter 25 is mounted somewhat in the center between the front wheels 21 and rear wheels 19 on a support platform 17.

FIG. 2 illustrates in a general way, the prior art approach to a wireless controlled battery operated wheel toy. A support platform 17 is shown with the top or automobile body removed. Prior art toys of this nature mount each non-driving wheel 19 and 27 on a separate axle. The driving wheels 29 and 21 are also each mounted on a separate axle. The axles of the driving wheels 29 and 21 are mounted to a wheel platform 31 which pivots around a shaft 33 that is normal to the wheel platform 31 and the support platform 17 of the automobile. The axle of driving wheel 29 is attached to a reduction gear 37, which is driven by a pinion gear connected to the shaft of motor 39. Likewise, the driving wheel 21 is attached to a reduction gear 35 which is driven by a pinion gear attached to the driving shaft of motor 41.

The speed of motors 39 and 41 is controlled by a two-channel transmitter and receiver (not shown), one channel being allocated to motor 39, and the other channel to motor 41. By varying the speed of rotation of the motors with respect to each other, the wheel platform 31 is caused to rotate with respect to the support platform, thereby causing the wheel toy to turn in one direction to the right, or in the other direction to the left.

This type of arrangement has performance disadvantages. Because the two driving motors are located at the front axle, they cannot be larger, higher efficiency motors. Therefore, the current draw of the smaller motors that must be used reduces the life of the supply battery considerably. Placement of both motors in front, also, creates difficulty in assembly. Having both motors in front locates the center of gravity toward the front. This causes the operability and control of the wheel toy to be considerably reduced. The use of a two-channel transmitter and receiver for controlling the motor speed of the two motors is complicated and expensive.

OBJECTS AND SUMMARY OF THE INVENTION

An object of this invention is to provide a wireless, remotely-controlled wheel toy that can utilize larger and more efficient motors, said motors being mounted so as to provide equal weight distribution on all the wheels.

Another object of this invention is to provide a wireless, remotely-controlled wheel toy that easily and faithfully responds to turning and straight ahead controls from the control device.

Yet another object of this invention is to provide a simple and inexpensive transmitter and receiver for providing wireless, remote-control of the wheel toy.

These objects and the general purpose of this invention are accomplished by providing a radio-controlled wheel toy that utilizes two DC motors, one motor being mounted at one axle and the other motor being mounted at the other axle of the wheel toy. One of the axle, wheel, and motor assemblies is mounted for pivotal rotation about an axis normal to the plane of the axle. A transmitter sends a modulated carrier signal to the receiver mounted in the approximate center of the wheel toy. The carrier is modulated by tone bursts. The duration of the tone bursts is determined by a variable potentiometer that is controlled by the operator. The receiver detects and demodulates the tone modulated carrier. The duration of the tone burst determines the time duration that current is supplied to one DC motor. The duration of the absence of a tone determines the time duration that current is supplied to the other DC motor. Controlling the current supplied to the two DC motors in this way controls their speed of rotation. The wheel toy turns left or right depending on which motor is rotating faster. The difference in speed of rotation of the two motors determines the turning circle radius of the wheel toy. If the speed of rotation of both motors is the same, the wheel toy will traverse a straight path.

BRIEF DESCRIPTION OF THE DRAWINGS

The exact nature of this invention, as well as other objects and advantages thereof will be readily apparent from consideration of the following specification in conjunction with the accompanying drawings in which like reference numerals designate like parts throughout the figures thereof, and wherein.

DESCRIPTION OF THE PREFERRED EMBODIMENTS

Figure 1:
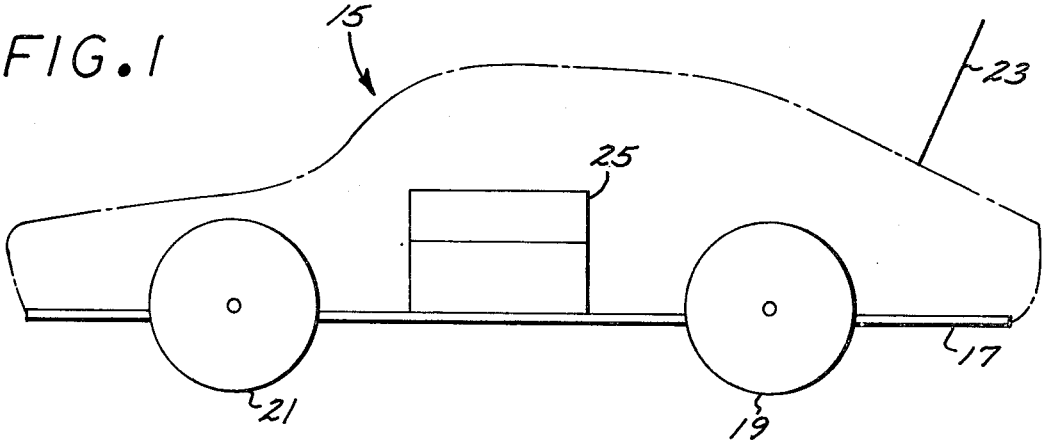
FIG. 1 is a side elevation partially in phantom of the basic elements of a wheel toy.
Figure 2:
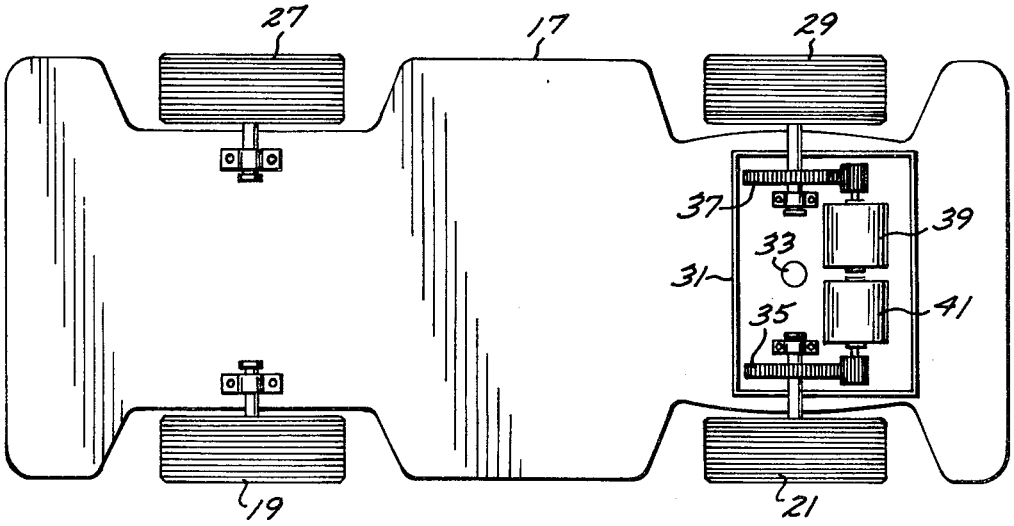
FIG. 2 is a top plan view with the body of the wheel toy removed, showing a prior art motor arrangement.
Figure 3:
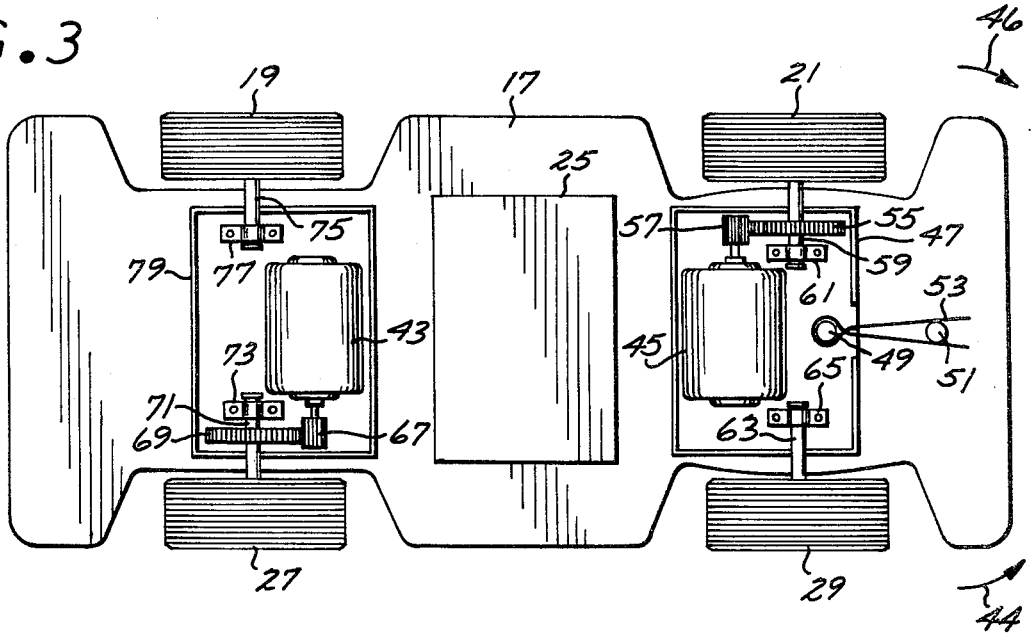
FIG. 3 is a top plan view with the toy body removed showing a parts configuration according to a preferred embodiment of the present invention.

Referring first to FIG. 3, the wheel toy support platform 17 is shown as supporting a pair of motors 43, 45, and a receiver 25 in a manner that will provide for approximately equal weight distribution on the four wheels 19, 21, 27 and 29 of the wheel toy.

The first pair of wheels 21 and 29 are mounted on a wheel platform 47 by a shaft and journal arrangement. The shaft 59 of wheel 21 is held to the wheel platform 47 by journal 61. The shaft 63 of wheel 29 is held to the wheel platform 47 by a journal 65. The shaft 59 has fixedly mounted thereon a reduction gear 55 which engages a pinion gear 57 mounted to the shaft of a DC drive motor 45. The DC drive motor 45 is also mounted on the wheel platform 47.

The wheel platform 47 is mounted for pivotal movement around pin 49 which is fixedly attached to the toy support platform 17 so that it is substantially normal to support platform 17 and wheel platform 47. A spring means 53 is held in place by another pin 51 which is fixedly attached to support platform 17 and is attached to wheel platform 47 in a well known manner. The purpose of spring means 53 is to bias the wheel platform 47 in a straight ahead orientation as illustrated in the figure.

The second set of wheels, 19 and 27, have respective shafts 75 and 71 held in place by respective journals 77 and 73. The journals of these wheels are fixedly held to the support platform 17 or to a wheel support platform 79 which is, in turn, fixedly held to the support platform 17. Shaft 71 has a reduction gear 69 fixedly attached to it. Reduction gear 69 engages pinion gear 67 which is on the shaft of DC drive motor 43. The DC drive motor 43, therefore, drives wheel 27 which is on the side opposite to wheel 21 which is driven by DC drive motor 45.

Under control of the wireless transmitted signals, as will be more fully explained hereinafter, the receiver 25 controls the speed of rotation of motors 43 and 45, which causes the wheel support platform 47 to pivot about pin 49 in direction 44 or direction 46, or not to pivot about pin 49. This causes the support platform 17 to move in the directions 44 or 46, or straight ahead, as controlled.

Traditionally, the wheel pair 21, 29 can be thought of as located at the front of the wheel toy, and the wheel pair 19, 27 as located at the rear of the wheel toy. However, this need not be the case. Steering control can also be accomplished if wheel pair 21, 29 is mounted on wheel support platform 47 at what is considered to be the rear of the vehicle, and wheel pairs 19, 27 are at the front. Indeed, both wheel support platforms 47 and 79 may be allowed to pivot.

Figure 4:
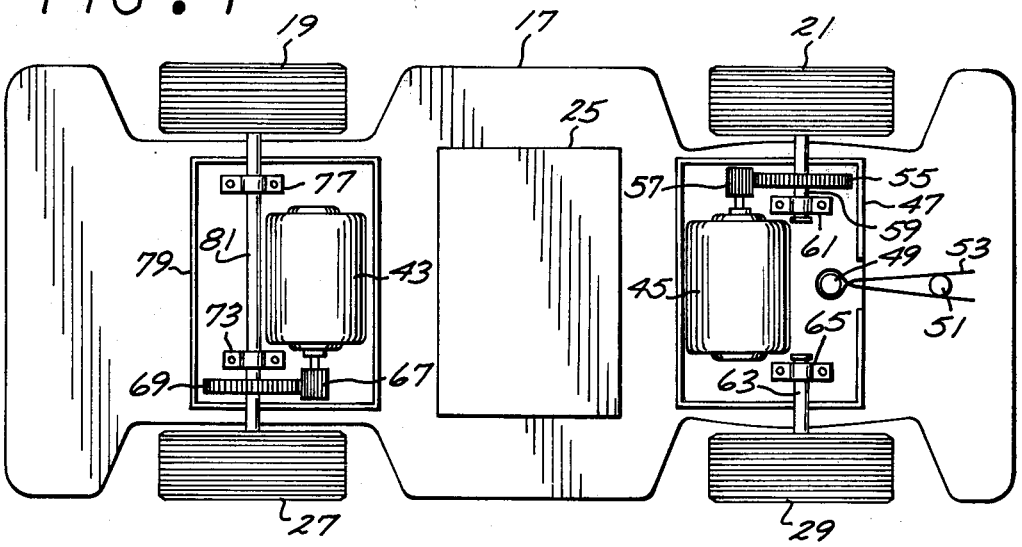
FIG. 4 is a top plan view with the body removed showing an alternate preferred embodiment of a configuration according to the present invention.

This is also true in the alternate embodiment shown in FIG. 4 wherein one of the wheel pairs 19 and 27 are both connected to a common axle shaft 81. The axle shaft 81 has a reduction gear 69 fixedly attached thereto which, when turned, causes both wheels 19 and 27 to be driven. This arrangement provides for increased stability in the control of straight ahead movement of the wheel toy.

If motors 45 and 43 are rotating at substantially equal speed, the wheel toy will travel in a straight line. If motor 43 is rotating slower than motor 45, a drag will be created at wheels 19, 27 that causes the wheel support platform 47 to pivot about pin 49 in a first direction. If motor 43 is rotating faster than motor 45, a drag on wheel 21 is created that causes the wheel support platform 47 to pivot about pin 49 in a second direction.

Figure 5:
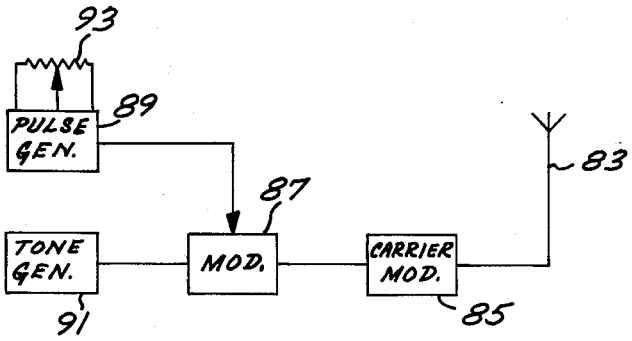
FIG. 5 is a block diagram of a preferred embodiment of the transmitter according to the present invention.
Figure 6:
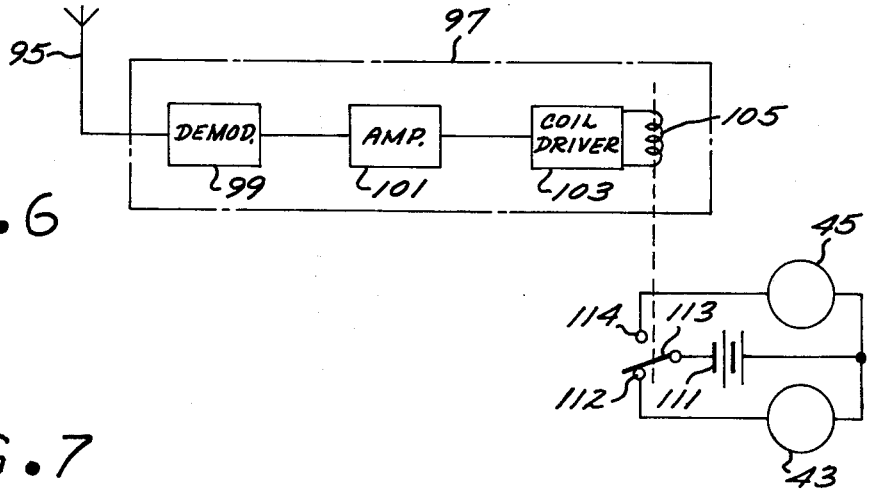
FIG. 6 is a block diagram of a preferred embodiment of a receiver and related control circuit according to the present invention.

Referring now to FIG. 5, a preferred embodiment of a remotely held transmitter which controls the speed of rotation of the two DC motors 43 and 45 is illustrated. The transmitter has an antenna 83 which emits a modulated carrier signal. This signal is generated as follows.

A variable resistor or potentiometer 93 forms a part of a pulse generating circuit 89. Circuit 89 generates pulses at the rate of 10–15 Hz. Varying the setting on the potentiometer 93 causes the width of the pulses generated to vary. These variable width pulses are supplied to what is effectively a modulator 87. The modulator 87 also receives an audio frequency tone signal from tone generator 91 (preferably 2 KHz). The pulse signals from pulse generator 89 modulates the tone signal from tone generator 91 in modulator 87 into tone bursts that have durations determined by the pulse widths from pulse generator 89. These tone bursts are supplied to a carrier modulating circuit 85 wherein the tone bursts are modulated onto a radio frequency carrier (preferably 27 MHz).

This tone burst modulated carrier signal is received by an antenna 95 (at the wheel toy) which is connected to a receiver 97 (mounted on the wheel toy), and specifically to demodulator circuit 99 wherein the tone bursts are recovered from the carrier. The tone bursts are supplied to an amplifier 101 wherein they are amplified and then supplied to a coil driver circuit 103. The tone bursts supplied to coil driver circuit 103 will actuate coil driver 105 for the period of time that a tone burst is received. It should be remembered at this point that the pulse generator 89 at the transmitter determined the duration of the tone bursts by the width of pulses being applied to the modulator 87.

During the time that a tone is received coil 105 is energized to move switch 113 from its normal contact position 112 to the alternate contact position 114. With switch 113 at position 114, DC motor 45 is being supplied current from a battery 111 and is therefore rotating. During the period of time when no tone burst is being received by the coil driver circuit 103, coil 105 is not energized. Switch 113 remains in its normal contact position 112, thereby causing motor 43 is be driven by battery 111.

In this manner, the duration of the tone bursts will determine the revolutions per minute or speed at which motor 45 is rotated, and consequently, the speed at which motor 43 is rotated. The motors 43 and 45 have sufficient inertia and the repetition rate of the tone bursts are received at a sufficiently fast rate so that the motors do not operate is spurts. Rather, smooth rotation is experienced from both motors.

Figure 7:
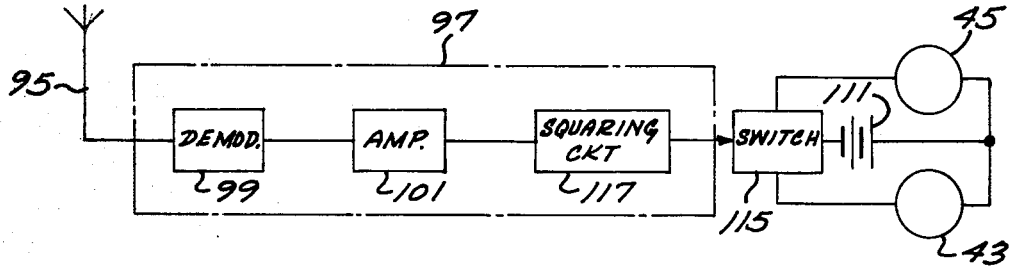
FIG. 7 is a block diagram of an alternate preferred embodiment of a receiver and related control circuit according to the present invention.
Figure 10:
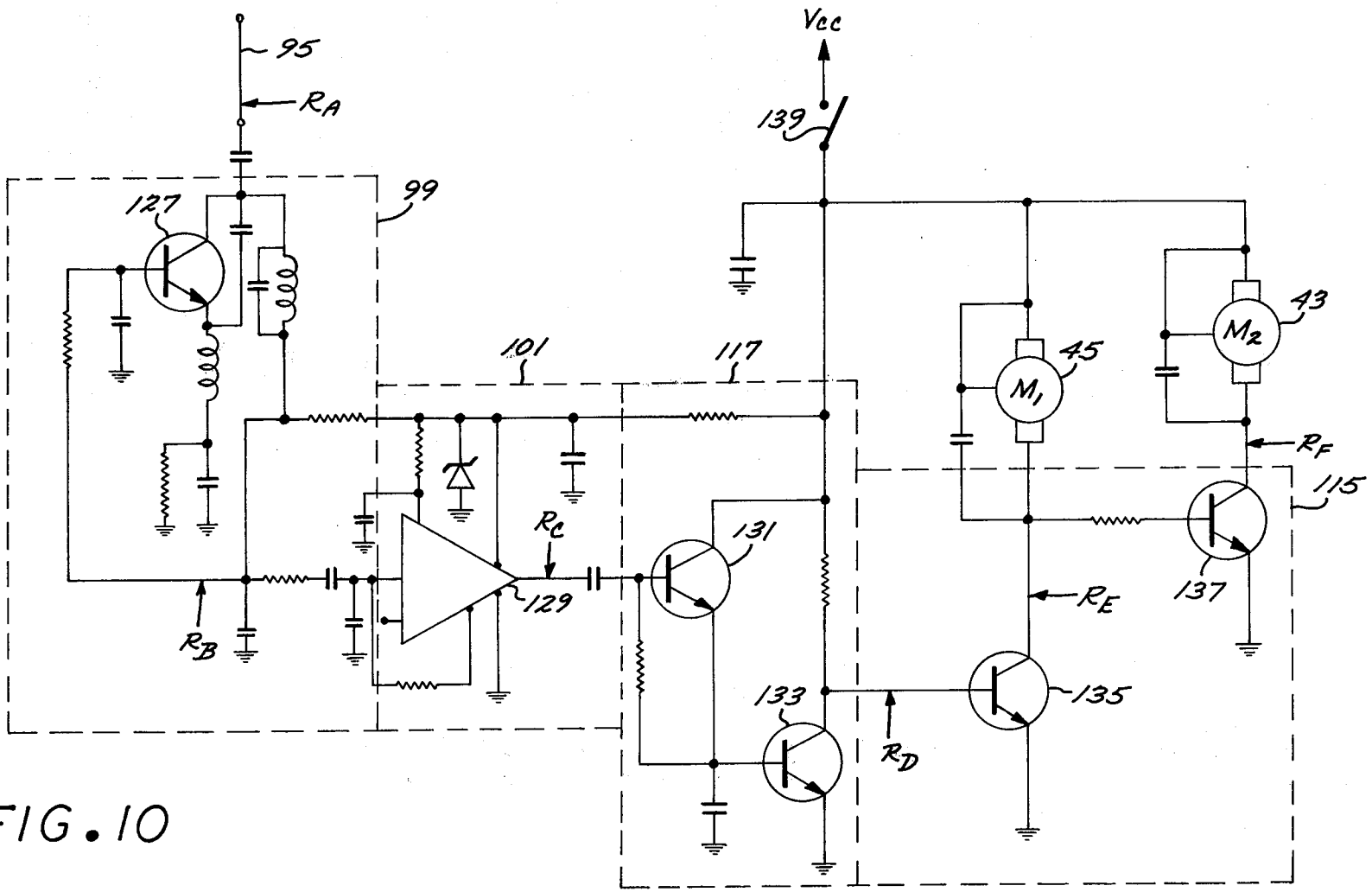
FIG. 10 is a schematic diagram of a preferred embodiment of a receiver according to the present invention.

An alternate embodiment for the receiver apparatus of wheel toy is shown in FIG. 7, wherein rather than using an electromagnetic coil and switch apparatus to alternate the current supplied to the motors 43 and 45, a transistor switching circuit 115 is utilized. Rather than a coil driver circuit, a pulse squaring circuit 117 receives the output of the amplifier 101 which will be remembered is the tone bursts demodulated from the radio frequency carrier. Squaring circuit 117 generates pulse signals therefrom which conform to the tone bursts received. These pulse signals are supplied to the transistor switching circuit 115 which will effectively switch the battery 111 between motors 45 and 43, again depending on the duration of the pulses or the pulse width, as determined by the duration of the tone bursts. A specific circuit to implement the block diagram of FIG. 7 is illustrated in FIG. 10.

Figure 8:
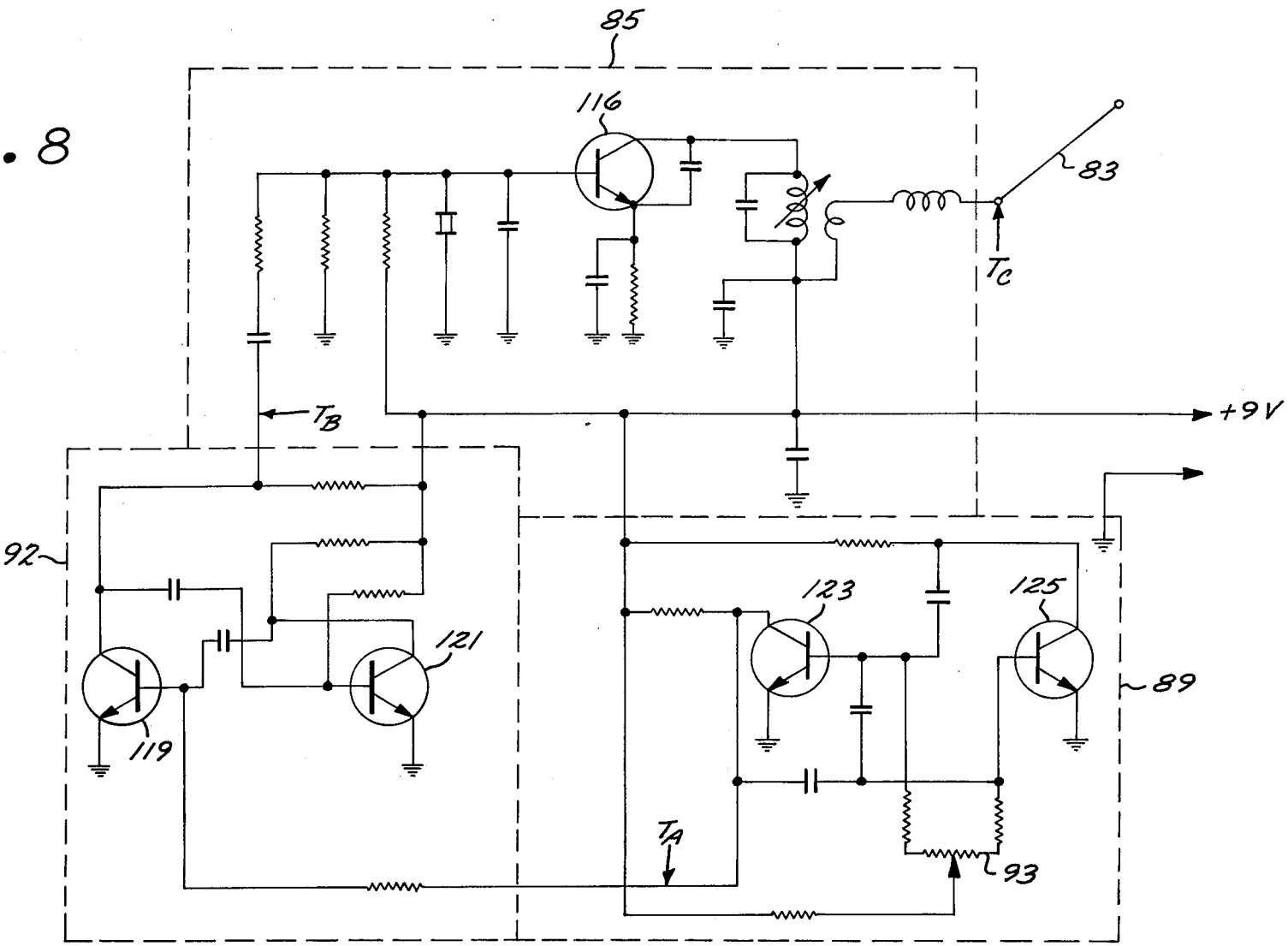
FIG. 8 is a schematic diagram illustrating a preferred embodiment of a transmitter according to the present invention.

First, however, reference is made to FIG. 8 for a specific circuit implementation of the transmitter of FIG. 5. Reference to FIG. 8 should be had in conjunction with FIG. 9, which illustrates the signals being generated at certain points of the circuit of FIG. 8. It can be seen that the transmitter of FIG. 8 includes a carrier modulating section 85 which is connected to a transmitting antenna 83, a pulse generating section 89, and a tone generator and modulating section 92 which performs the function of the tone generator 91 and the modulating section 87 of the FIG. 5 block diagram.

The pulse generating section 89 is made up of a pair of transistors 123, 125 arranged in a flip-flop configuration wherein a variable potentiometer 93 controls the symmetry of the pulses being outputted by the circuit at point $T_A$. That is, the time duration of the pulses generated is varied by the setting on potentiometer 93. Considering the extremes, potentiometer 93 could be set so that a continuous high level is generated at point $T_A$, or no level is generated at point $T_A$. The setting on potentiometer 93, along with transistor 125, controls the on and off switching sequence of transistor 123. Assuming, for example, that transistor 123 is on, current will flow from the nine-volt voltage supply through transistor 123 to ground, thereby keeping transistor 119 of the tone generator modulator turned off because no bias is applied to its base. However, when transistor 123 is off, the nine-volt voltage supply will bias transistor 119 on for a duration determined by transistor 121 and the circuits associated therewith.

Figure 9:
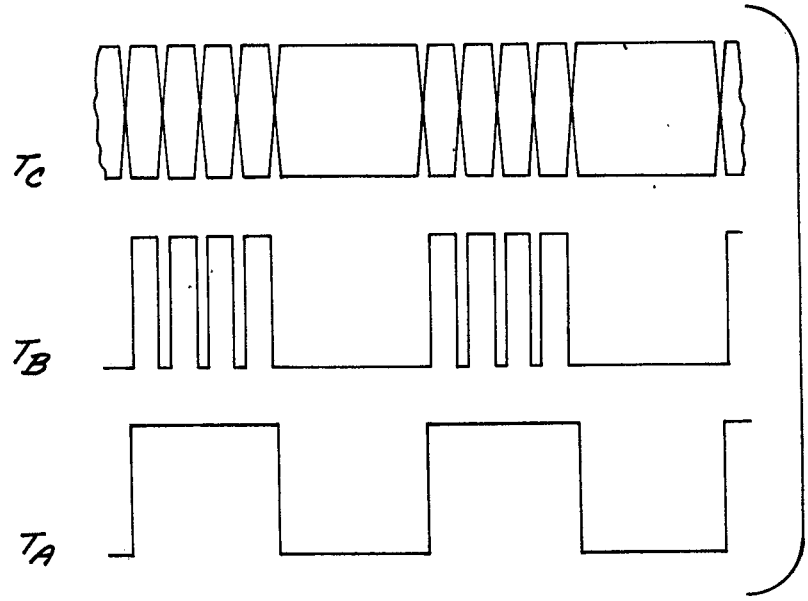
FIG. 9 is a series of waveforms illustrating the signals generated in the transmitter of FIG. 8.

The output signal at $T_A$ as a result of transistor 123 turning on and off as directed by transistor 125, and the associated circuitry, including variable potentiometer 93, is illustrated as pulse signal $T_A$ in FIG. 9. When transistor 123 is on, $T_A$ is low. When transistor 123 is off, $T_A$ is high. The width of the pulses (the duration that transistor 123 is off) will increase or decrease depending upon the setting of the potentiometer 93. The absolute extremes, of course, will be a continuous low level or a continuous high level. The frequency of the $T_A$ pulses that provide steering control is preferably at 10–15 Hz.

The signal $T_A$ is supplied to the base of transistor 119, causing it to conduct or not conduct, depending on the duration of the high level being supplied thereto. Circuit 92 is a tone generator wherein a signal output, preferably of 2 KHz, is generated, depending upon whether transistor 119 is on or off. If transistor 119 is on, commensurate with a pulse being supplied to it at its base, a 2 KHz tone is being generated during the time period defined by the duration of the pulse. When transistor 119 is off, no tone is generated from circuit 92. This can be seen in FIG. 9 as signal $T_B$. The tone bursts $T_B$ are supplied to an RF generator modulator having transistor 117 therein. This circuit generates a radio frequency signal, preferably of 27 MHz. Signal $T_B$ modulates this carrier signal in a well known manner to produce the modulated carrier signal illustrated as $T_C$ in FIG. 9 at the transmitting antenna 83.

Figure 11:
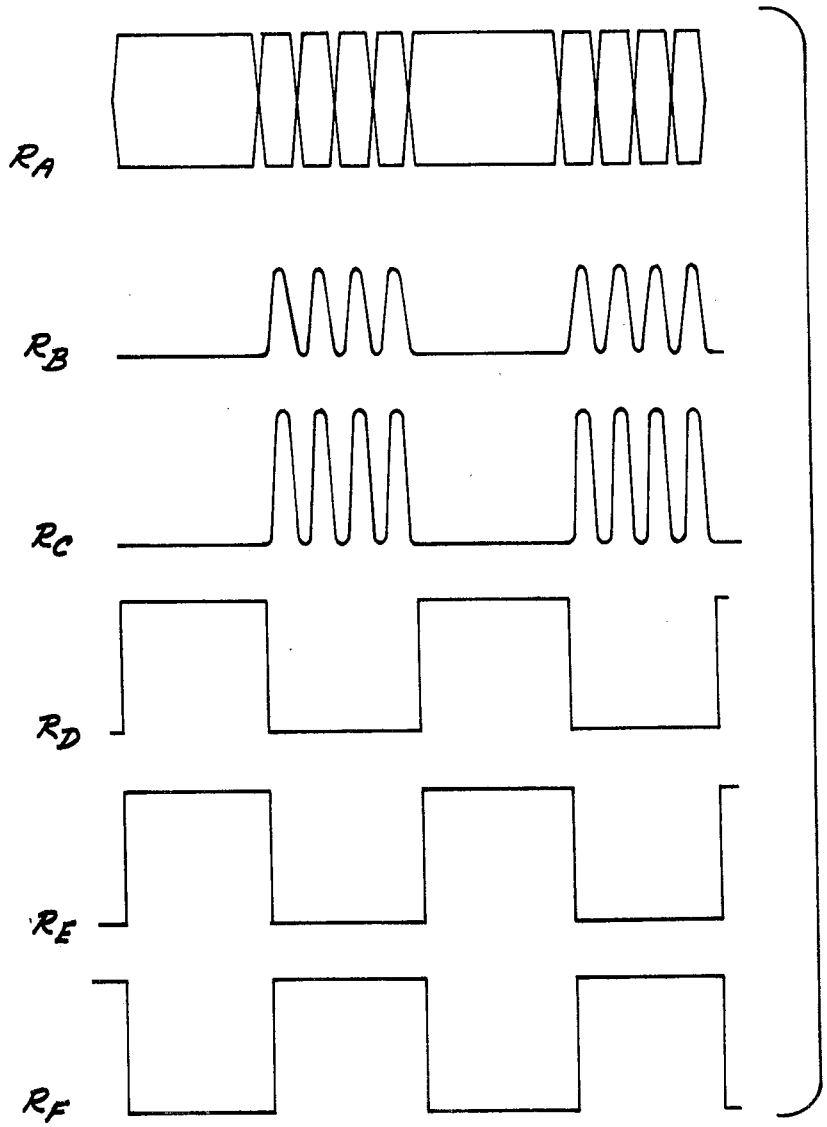
FIG. 11 is a series of wave diagrams illustrating the signals generated at various points of the receiver of FIG. 10.

This signal is received by the receiving antenna 95 at the wheel toy (FIG. 10), and is shown in FIG. 11 as receiving signal $R_A$. The schematic of the receiver (FIG. 10) of the wheel toy is illustrated as having a demodulator section 99, an amplifier section 101, a squaring circuit section 117, and a switching circuit 115, which is connected to a first motor 45 and a second motor 43. The entire receiver is supplied through a switch 139 from a battery voltage source $V_{CC}$.

Upon receiving the tone burst modulated carrier signal $R_A$ at its antenna 95, the carrier signal is demodulated in demodulator section 99 which has a transistor 127 therein. The demodulator section 99 provides the demodulated tone bursts $R_B$ at the point shown in FIG. 10 to the input of the amplifier section 101, which contains an operational amplifier 129 therein. The output of the operational amplifier 129, $R_C$ is amplified tone bursts. These amplified tone bursts are supplied to the pulse squaring circuit 117 which simply generates a pulse signal train $R_D$ (FIG. 11) at its output. The pulses in the signal train are equal in duration to the time the tone burst signals are not being received by transistor 131.

Thus, during the time that a tone burst is not being received at the receiver, the output $R_D$ of the squaring circuit 117 is high, causing transistor 135 of switching circuit 115 to be biased on. This permits a current flow from the $V_{CC}$ supply through first motor 45 through transistor 135 to ground, as is illustrated by the signal $R_E$ in FIG. 11. While transistor 135 is on, transistor 137 is held off because current flowing through transistor 135 reduces the bias at the base of transistor 137 below its turn-on level.

However, when a tone is received, the output $R_D$ of squaring circuit 117 drops to a low level, turning transistor 135 off, thereby permitting the bias of transistor 137 to build up to a point where it turn on, causing current to flow through the second motor 43 from the voltage supply $V_{CC}$ through transistor 137 to ground, as is illustrated by the signal $R_F$ in FIG. 11.

Thus, it can be seen that the switching circuit 115, specifically, transistors 135 and 137, alternately turn the first motor 45 or the second motor 43 on and off, depending upon the duration of the tone bursts being received.

Figure 12A:
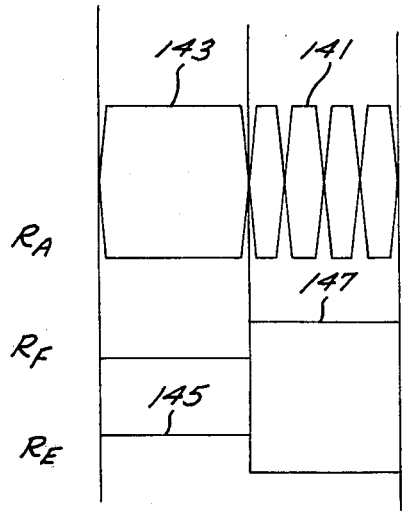
FIGS. 12A, B and C are a series of wave diagrams illustrating how the signals in the receiver of FIG. 10 vary to effectuate steering control.
Figure 12B:
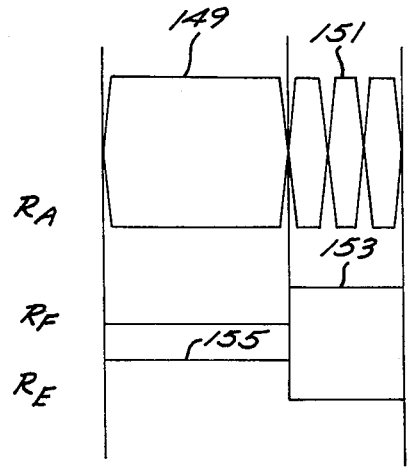
Figure 12C:
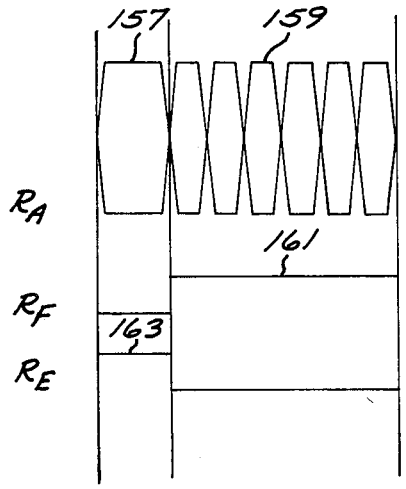

Reference should now be made to FIGS. 12A, 12B and 12C, which illustrate the variations that can occur in the receiver of FIG. 10, and the other receiver embodiments illustrated.

FIG. 12A illustrates the situation where the transmitted and received carrier signal $R_A$ illustrates an equal symmetry. That is, the duration of the tone bursts modulated portion 141 of the carrier $R_A$ is equal to the duration of the unmodulated portion 143 of the carrier $R_A$. This results in a time duration 145 that current is being supplied to the first motor 45 equal to the time duration 147 that current is being supplied to the second motor 43. Thereby, both motors are receiving the same amount of power resulting in both motors turning at the same speed. This results in straight-ahead movement of the wheel toy.

FIG. 12B illustrates the situation where the time duration of the tone burst modulated portion 151 of the carrier $R_A$ is shorter than the time duration of the unmodulated portion 149 of the carrier $R_A$. This results in the time duration 153 that the second motor 43 is turned on being much less than the time duration 155 that the first motor 45 is turned on. Thereby, motor 45 is turning faster than motor 43. As a result, the wheel toy will turn in a first direction.

FIG. 12C illustrates the situation where the unmodulated portion 157 of the carrier wave has a much shorter time duration than the tone burst modulated portion 159 of the carrier signal $R_A$. As a result, the time duration 161 within which current is supplied to the second motor 43 is greater than the time duration 163 within which current is supplied to the first motor 45. As a result, second motor 43 is turning faster than the first motor 45, and the wheel toy turns in the second direction.

From the above description it can be seen that the present invention provides an improved wireless remote-controlled wheel toy that can utilize larger and more efficient motors, and which are mounted to provide equal weight distribution on the wheels, and thereby provide a wheel toy that easily and faithfully responds to turning and straight ahead control commands from the transmitting device, and provides a remote-controlled wheel toy which is simple, uses a simple and inexpensive transmitter and receiver for providing wireless remote control. It should be understood, of course, that the foregoing disclosure relates to preferred embodiments of the invention, and that modifications may be made therein without departing from the spirit and scope of the invention as set forth in the appended claims.

What is claimed is:

1. A radio-controlled wheel toy having a first pair and a second pair of wheels wherein a hand-held transmitter with a manually manipulateable means therein transmits signals to a receiver mounted on a support platform of the wheel toy for controlling the direction of movement of said wheel toy, the improvement therein comprising: p1 said first pair of wheels rotatably mounted on a wheel platform, said platform being mounted for pivotal movement relative to said support platform of the wheel toy;

a first motor means mounted on said wheel platform in proximity to said first pair of wheels and connected for driving one of said pair of wheels; and a second motor means mounted in proximity to said second pair of wheels and connected for driving at least one of said second pair of wheels wherein the wheel that is driven by the second motor is positioned on the opposite side of the car from at least one of the wheels driven by said first motor.

2. The radio-controlled wheel toy of claim 1 wherein said second motor means is connected for driving the one of said second pair of wheels that is on the side of the wheel toy opposite to the side of the driven wheel of said first pair of wheels.

3. The radio-controlled wheel toy of claim 1 wherein said second motor means is connected for driving both of said second pair of wheels.

4. The radio-controlled wheel toy of claim 1 further comprising spring means connected between said wheel platform and said support platform for housing said wheel platform to align the wheels mounted thereon substantially parallel with the support platform.

5. The radio-controlled wheel toy of claim 1 wherein said first motor means and said second motor means are DC motors.

6. A radio-controlled wheel toy having a first pair and a second pair of wheels and a hand-held transmitter with a manually manipulateable means transmitting signals to a receiver mounted on a support platform of the wheel toy for controlling the direction of movement of the wheel toy, the improvement therein comprising:

said first pair of wheels rotatably mounted on a wheel platform, said platform being mounted for pivoted movement relative to said support platform of the wheel toy;

a first motor means mounted on said wheel platform in proximity to said first pair of wheels and connected for driving one of said pair of wheels;

a second motor means mounted in proximity to said second pair of wheels and connected for driving both of said second pair of wheels;

said transmitter including a pulse generating means for generating pulses having varying widths as determined by a manually manipulated variable resistor;

a tone generator for generating an audio frequency tone;

means for modulating the variable width pulses from said pulse generating means on said tone from said tone generator; and means for modulating the modulated tone signal on a high frequency carrier wave said receiver including demodulating means for detecting and receiving the modulated tone signal; and means responsive to said modulated tone for supplying current to said first motor means as long as said tone is present and for supplying current to said second motor means as long as said tone is absent.

7. The radio-controlled wheel toy of claim 6 wherein said tone responsive means comprises:

a voltage source connected to said first motor and said second motor at a common end;

a switch means connecting said voltage source to the other end of either said first or said second motor depending on whether the switch is actuated or unactuated; and means for actuating said switch means for the duration of the reception of a tone signal.

8. The radio-controlled wheel toy of claim 6 wherein said tone responsive means comprises:

a voltage source connected to said first motor and said second motor at a common end;

a switch means closing a current path for said first motor or said second motor; and a squaring circuit means for generating pulses having a duration that is equal to the duration for which said tone is not received, the pulses of said squaring circuit actuating said switch means.

9. The radio-controlled wheel toy of claim 6 wherein said tone responsive means comprises:

a voltage source connected to said first motor and said second motor at a common end;

a squaring circuit means for generating pulses having a duration that is equal to the duration for which said tone is not received;

a first transistor switch means connected to said first motor means and ground, said switch means actuated by the pulses from said squaring circuit for closing the path between said first motor means and ground; and a second transistor switch means connected to said second motor means and ground, said second switch means being actuated when said first switch means is unactuated.

* * * * *

UNITED STATES PATENT AND TRADEMARK OFFICE

CERTIFICATE OF CORRECTION

PATENT NO. : 4,213,270
DATED : July 22, 1980
INVENTOR(S) : Nobuo Oda

It is certified that error appears in the above—identified patent and that said Letters Patent is hereby corrected as shown below:

Column 6, line 35, delete "turn" and insert --turns--.

Column 7, line 34, after the word "comprising:", delete entire line;

Column 7, line 34, beginning with the words "said first pair of wheels rotatably" through the word "toy;" on line 37, should be a separate paragraph.

Signed and Sealed this

*Twenty-third* Day of *December 1980*

[SEAL]

*Attest:*

SIDNEY A. DIAMOND

*Attesting Officer*

*Commissioner of Patents and Trademarks*